United States Patent [19]

Milne et al.

[11] Patent Number: 4,499,966

[45] Date of Patent: Feb. 19, 1985

[54] EMERGENCY ESCAPE SYSTEM

[75] Inventors: William G. Milne; Minoru Saruwatari, both of Calgary, Canada

[73] Assignee: Tundra Holdings Ltd., Calgary, Canada

[21] Appl. No.: 468,392

[22] Filed: Feb. 22, 1983

[51] Int. Cl.[3] ..... A62B 1/20

[52] U.S. Cl. ..... 182/3; 182/82; 187/6

[58] Field of Search ..... 182/3-8, 182/233, 234, 235, 82, 141; 187/6

[56] References Cited

U.S. PATENT DOCUMENTS

| | | | |
|---|---|---|---|
| 2,647,675 | 7/1953 | Bernett . | |
| 3,207,263 | 4/1965 | Cull . | |
| 3,348,632 | 5/1967 | Swager . | |
| 3,715,011 | 11/1973 | Prather . | |
| 3,831,711 | 7/1974 | Smith . | |
| 3,861,497 | 11/1975 | Tsai . | |
| 3,944,021 | 6/1976 | Smith et al. . | |
| 3,946,989 | 10/1976 | Tsuda . | |
| 4,063,615 | 3/1977 | Knepp . | |
| 4,093,186 | 4/1978 | Golden . | |
| 4,121,689 | 4/1978 | Bonvin . | |
| 4,125,172 | 6/1978 | Hatala . | |
| 4,271,927 | 9/1981 | Brown . | |
| 4,350,224 | 9/1982 | Jochum | 182/141 |
| 4,406,349 | 9/1983 | Vilchek | 182/7 |

*Primary Examiner*—Reinaldo P. Machado
*Attorney, Agent, or Firm*—Larson and Taylor

[57] ABSTRACT

A gravity operated emergency system for a multi-story building is disclosed including an elongate track having a central rack which is disposed along an outside wall of the building. A traveller is provided which moves along the track and has a pinion which rotatably engages the rack. A pair of bearing members engage opposite sides of the track and these bearing members are pivotally attached to the traveller so that as the pinion is brought into contact with the rack the bearing members clear the respective sides of the track and when the pinion is fully engaged in the rack the bearing members are resiliently urged into contact with an inside face of the track. A velocity control mechanism is provided to control the rotational speed of the pinion in the rack, and hence the speed of the traveller relative to the track. During an emergency, the user is received in a harness which is connected to the traveller and the traveller slowly lowers the user to safety along the track.

16 Claims, 4 Drawing Figures

EMERGENCY ESCAPE SYSTEM

FIELD OF THE INVENTION

The present invention relates generally to an emergency escape exit for persons located in a multi-story building, and more particularly to an emergency escape system which automatically lowers a user slowly to the ground along a track along an outside wall of the building.

BACKGROUND OF THE INVENTION

In order to provide some means of emergency exit for occupants located above a fire in a multi-story building, one or more outside fire escape stairs are frequently provided on the outside of the building. Unfortunately, such fire escape stairs are not favored by builders for a number of reasons. First, the fire escape stairs are considered unsightly and incompatible with modern architecture. Second, the fire escape stairs are costly and frequently require some maintenance. Third, the fire escape stairs can provide an easy access for unwanted intruders. The addition of fire escape stairs to an older building may also be not only difficult and almost impossible but dangerous for the workers attempting to install such a device.

In order to overcome the problems associated with fire escape stairs, a number of other emergency escape systems have been disclosed. One such system, disclosed in U.S. Pat. No. 4,121,689 (Bonvin), includes a vertically disposed power rail with a rack within this rail. A suspension apparatus is insertable in the rail to engage the rack and slowly lower a person strapped to the suspension apparatus. A powered lowering and raising device using a rack located on an I beam is disclosed in U.S. Pat. Nos. 2,647,675 (Burnett) and 3,207,263 (Cull). Various other gravity lowering devices have also been disclosed including a device following a zigzag track disclosed in U.S. Pat. No. 4,125,172 (Hatala) and a carrier having a brake which engages a vertical cylindrical column or the like disclosed in U.S. Pat. No. 3,715,011 (Prather). Power driven lowering apparatuses which lower a carrier seat engaging a roller chain or helical screw have also been disclosed in U.S. Pat. Nos. 3,831,711 (Smith) and 3,944,021 (Smith et al).

Another type of prior art escape device engages a cable or rope. For example, a slow decent mechanism received on a rope, disclosed in U.S. Pat. No. 3,946,989 (Tsuda), is used to lower the user to the ground slowly by means of an oil hydraulic braking device. Other speed regulators for ropes are disclosed in U.S. Pat. Nos. 3,861,497 (Tsai) and 4,093,186 (Golden). Besides traversing a hanging rope or cable, an escape device is disclosed in U.S. Pat. No. 4,063,615 (Knepp) in which an escape device includes a drum about which a cable is slowly unwould to lower the user to the ground.

Also disclosed in the prior art in U.S. Pat. No. 3,348,632 (Swager) is a safety device which is used as a climbing aid. The safety device is received on the plate of an H rail which is mounted adjacent a ladder. The safety device is attached to the user and moves freely along the H rail as the user ascends or descends on the ladder. Should the user slip from the ladder, the sudden downward movement causes the safety device to securely grip the H rail and prevent the user from falling further. A roller assembly which engages a horizontal, inverted T rail and supports a suspended cradle is also disclosed in U.S. Pat. No. 4,271,927 (Brown et al). The roller assembly includes two pivoted arms which can be moved from engagement or locked in place from a central pivot point.

There are a number of disadvantages associated with escape devices such as those disclosed above. For example, the track or rail which some of the devices travel on is unduly complicated and expensive to produce. In addition, some of these rails require special attachments to the wall and special access openings for the lowering device. A disadvantage with the rope and cable devices is that it is difficult to provide a cable which is usable by all the floors but rather a multitude of cables usable from each floor is usually necessary.

SUMMARY OF THE INVENTION

In accordance with the present invention, a gravity operated emergency escape system for a multi-story building is provided. The escape system includes an elongate track which is vertically disposed and spaced from a wall of the building. The track includes an inside face and an outside face having a rack disposed along the center thereof. A traveller which is designed to move along the track is also provided. The traveller includes a pinion which rotatably engages the rack and a pair of bearing members which engage opposite horizontal sides of the inside face of the rack. Preferably, the bearing members are pivoted to the traveller so as to clear respective sides of the track as the pinion is brought into contact with the rack and to thereafter resiliently urge the bearing member into bearing contact on the inside face of the track after the pinion fully engages the rack. A velocity control means is connected to the pinion and controls the rotational speed of the pinion and hence the speed of the traveller relative to the track. In use, the user is received in a harness which is connected to the traveller and the traveller is then located on the track and slowly lowers the user to safety.

In the preferred embodiment of the present invention, the pivot axis of each bearing member is located closer than any part of a respective bearing member to a vertical plane which is perpendicular to the wall and which passes through the vertical center line of the inside face. With this construction, the moment about the pivot axis caused by each bearing member engaging the inside face urges each bearing member toward the vertical centerline of the inside face. The pinion is also disposed in the center of the traveller and a second pair of bearing members pivotally attached to the traveller are also provided so that the traveller can operate with either end up.

According to the preferred embodiment of the present invention, the velocity control means includes a first oil-hydraulic brake connected to the pinion. In addition, the velocity control means also includes a second oil-hydraulic brake similarly connected to the pinion. The two brakes serve as a redundant safety mechanism for the traveller.

It is an object of the present invention to provide an emergency escape system which is readily accessible to the occupants on all floors of a multi-story building.

It is a feature of the present invention that the traveller used to lower the user to the ground is easily and securely attachable to the vertically extending track. It is a further feature of the present invention that movement of the traveller is gravity operated so that no external power source is needed.

It is an advantage of the present invention that the carriage can be conveniently stored in a small space and be immediately ready for us.

It is a further advantage of the present invention that during the descent of the traveller, the traveller requires no attention so that the injured or unconscious may be lowered without supervision.

Other objects, features, and advantages of the present invention are stated in or are apparent from a detailed description of a presently preferred embodiment of the invention found hereinbelow.

DETAILED DESCRIPTION OF THE PREFERRED EMBODIMENT

Figure 1:
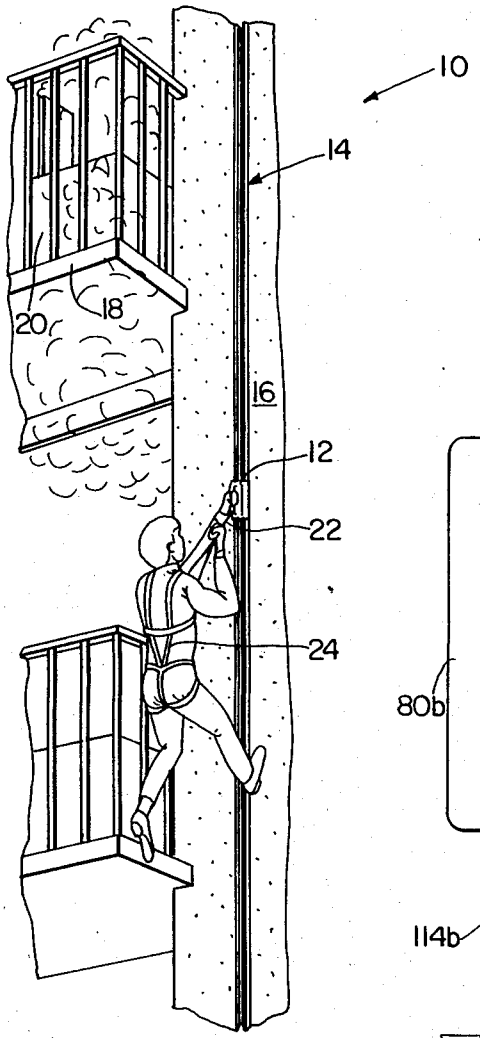
FIG. 1 is a perspective view of an emergency escape system according to the present invention.

With reference now to the drawings in which like numerals represent like elements throughout the several views, a presently preferred embodiment of an emergency escape system 10 is depicted in FIG. 1. Emergency escape system 10 includes a traveller 12 which rides along a specially designed track 14. Track 14 is vertically disposed along a wall 16 of a multi-story building. Track 14 is also located adjacent an emergency exit from the interior of the multi-story building such as balcony 18. Provided adjacent the emergency exit, such as on balcony 18 is a storage cabinet 20 in which a plurality of travellers 12 are stored ready for use. Both balcony 18 and storage cabinet 20 are preferably locked and remote switches are provided which are accessible to emergency evacuation personnel to unlock balcony 18 and storage cabinet 20 during an emergency situation.

As shown in FIG. 1, a harness connector 22 is attached to traveller 12. Also connected to harness connector 22 is a harness 24, such as a parachute harness or the like. The user is received in harness 24 and is shown being slowly lowered by traveller 12 traveling along track 14.

Figure 4:
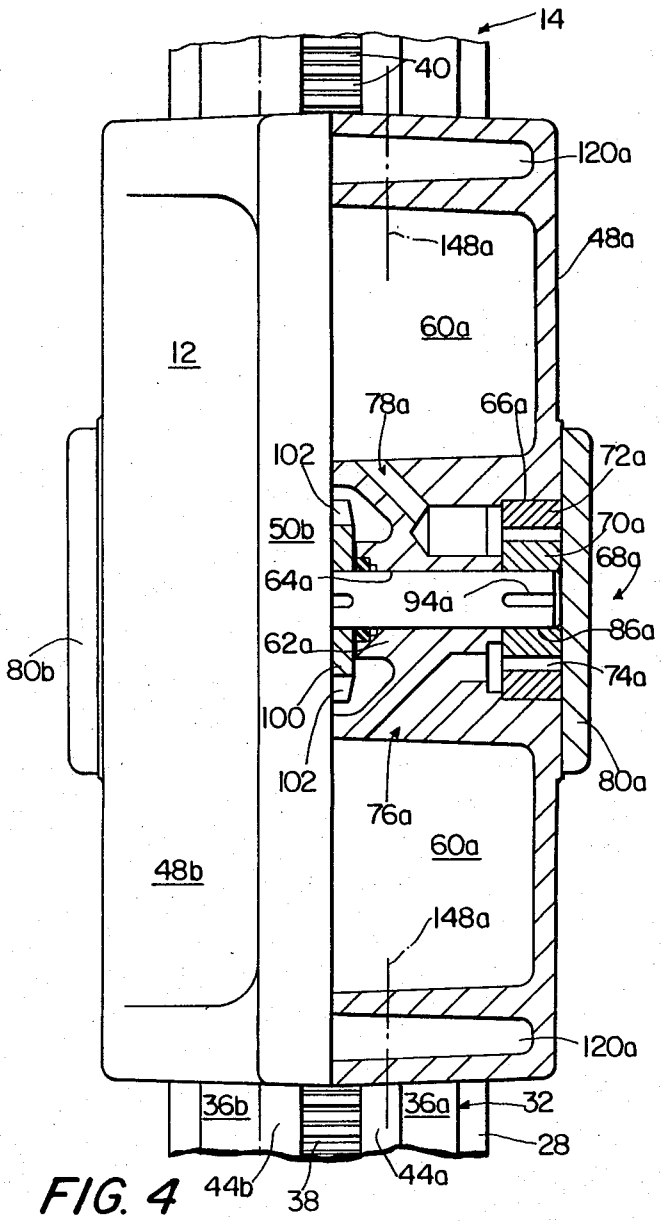
FIG. 4 is a partically cut away front elevation view of the traveller depicted in FIG. 2.
Figure 3:
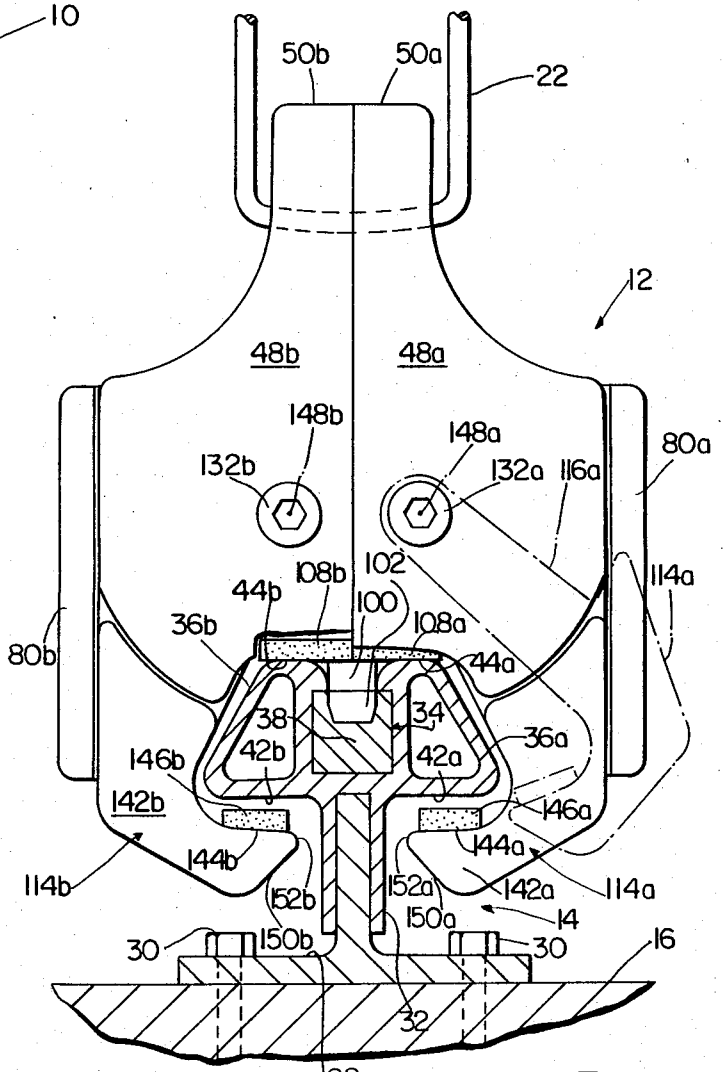
FIG. 3 is a top plan view of the traveller depicted in FIG. 2.
Figure 2:
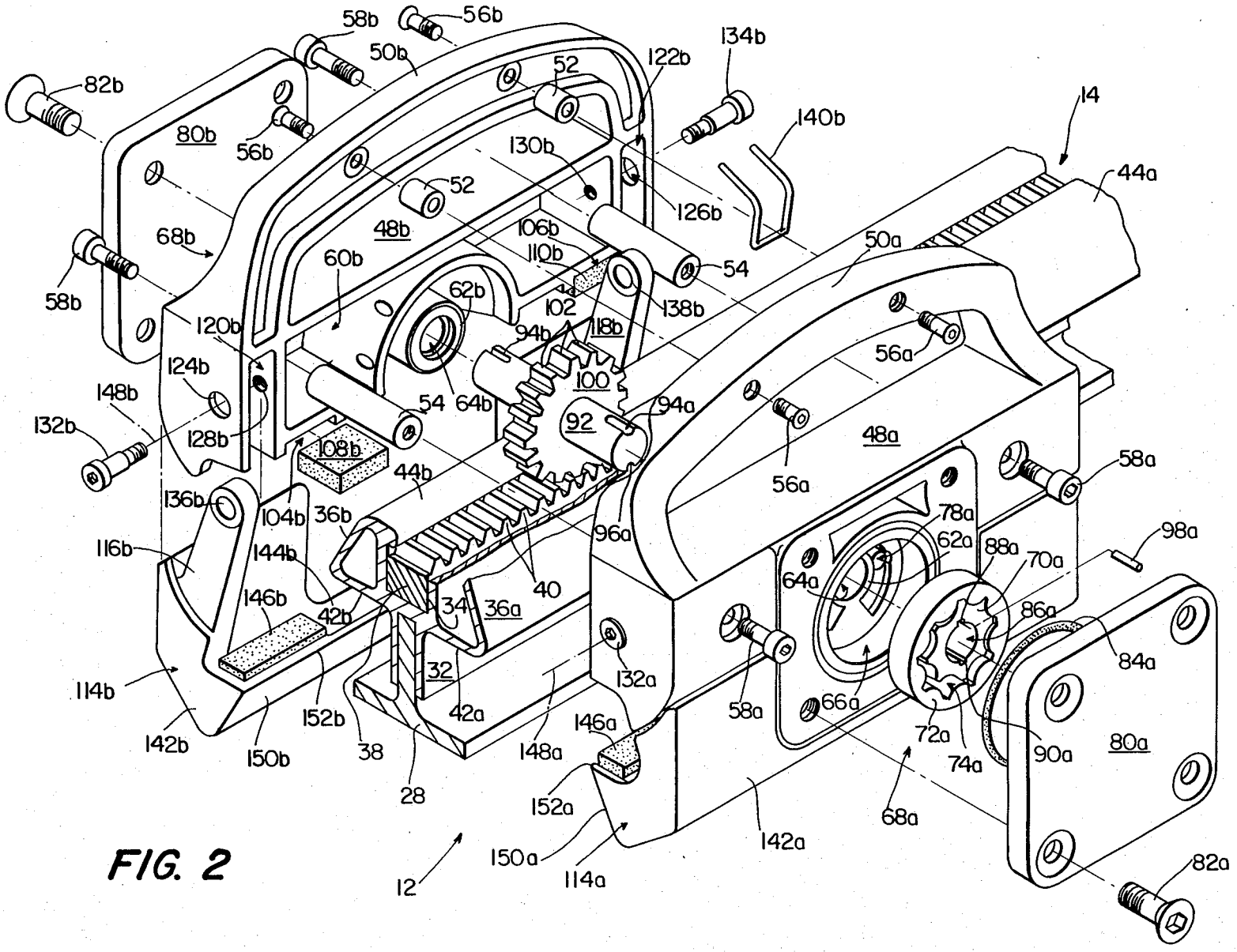
FIG. 2 is an exploded perspective view of the traveller depicted in FIG. 1.

Depicted in greater detail in FIGS. 2, 3, and 4 are traveller 12 and track 14. As shown, track 14 includes a T beam 28 which is securely attached to wall 16 by anchors 30. Securely attached to the central leg of T beam 28 is a specially designed beam 32 having a central longitudinal channel 34 and sloping faces **36*a* and 36*b*. Immovably located in channel 34 is a rack 38 whose teeth 40 face away from wall 16. Beam 32 includes inside faces 42*a* and 42*b* and outside faces 44*a* and 44*b***.

Traveller 12 includes two symmetrical halves whose elements will be identified using corresponding numbers having a suffix "a" or "b" depending on which half that particular element goes with. For convenience, the elements of one half or the other may be described in detail while the corresponding elements are merely identified in the drawings with the corresponding numeral and suffix. As shown in FIGS. 2, 3 and 4, traveller 12 includes symmetrical housings **48*a* and 48*b* having handles 50*a* and 50*b*. Housings 48*a* and 48*b* are held together by means of spacers 52 and 54 in which bolts 56*a*, 56*b* and 58*a*, 58*b* are, respectively, received. As shown best in FIG. 2, housing 48*b* encloses a chamber 60*b***.

Located centrally of housing **48*b* and below chamber 60*b* is a journal bearing 62*b* containing a cylindrical aperture 64*b*. As shown, corresponding cylindrical aperture 64*a* extends into an enlarged cylindrical aperture 66*a*. Located in cylindrical aperture 66*a* is a Gerotor fixed displacement pump 68*a* including a rotor 70*a* and an eccentrically mounted pump cartridge 72*a*. The space between the inner periphery of pump cartridge 72*a* and the outer periphery of rotor 70*a* constitutes a pump chamber 74*a*. Two openings 76*a* and 78*a* are provided on opposite sides of cylindrical aperture 64*a* so as to connect chamber 60*a* with pump chamber 74*a*. Cylindrical aperture 66*a* is closed by a cover 80*a* which is held in place by bolts 82*a*. A seal 84*a* is provided around cylindrical aperture 66*a* between cover 80*a* and housing 48*a***.

Rotor **70*a* is provided with a central opening 86*a* and two small slots 88*a* and 90*a*. A shaft 92 extends through journal bearing 62*a* and cylindrical aperture 64*a* into opening 86*a*. The longitudinal ends of shaft 92 are also provided with slots 94*a* and 96*a* which match slots 88*a* and 90*a*, respectively. Together, slots 88*a* and 94*a* form a cylindrical opening in which a key 98*a* is received so that shaft 92 and rotor 70*a* rotate as a unit. A similar key (not shown) is also fitted into mating slots 90*a* and 96*a***.

Immovably mounted on shaft 92 is a pinion 100. Pinion 100 includes teeth 102 which matingly engage teeth 40 of rack 38. It should be appreciated that when pinion 100 engages rack 38, rotation of pinion 100 causes pumps **68*a* and 68*b*** to operate in the matter to be explained subsequently.

As shown best in FIGS. 2 and 3, channels **104*b* and 106*b* are provided on opposite sides of shaft 92 on the underside of housing 48*b*. Received in channels 104*b* and 106*b*, respectively, are suitable bearing members such as gliders 108*b* and 110*b*. Gliders 108*b* and 110*b* are designed to engage inside face 42*b* of beam 32 and to slide smoothly therealong. Gliders 108*b* and 110*b* are secured in channels 104*b* and 106*b***, respectively, and are made of a suitable wear resistant material.

Pivotally attached to housings **48*a* and 48*b* are latches 114*a* and 114*b*. As shown best in FIG. 2, latch 114*b* is pivotally attached to housing 48*b* on opposite sides thereof through arms 116*b* and 118*b*. Arms 116*b* and 118*b* are received in channels 120*b* and 122*b*, respectively. As shown, each channel is provided with an outer hole 124*b* and 126*b*, respectively, and an inner threaded hole 128*b* and 130*b*, respectively. Arms 116*b* and 118*b* are rotatably held to housing 48*b* by bolts 132*b* and 134*b* which are respectively received in bores 136*b* and 138*b* provided in the ends of arms 116*b* and 118*b*, respectively. A spring clip 140*b* is provided to urge arms 116*b* and 118*b* to pivot about bolts 132*b* and 134*b*, respectively, toward track 14. As shown in FIG. 2, spring clip 140*b* passes around bolt 134*b* with the free ends of spring clip 140*b* engaging the top of channel 122*b*. The other end of spring clip 140*b* is tucked behind arm 118*b* and engages the surface of 118*b* most distant from track 14. In this manner, spring clips 140*b* resiliently urge latch 114*b* toward track 14**.

Latch **114*b* also includes a base 142*b* extending between arms 116*b* and 118*b*. Base 142*b* includes a flat surface 144*b* to which suitable bearing members such as glider 146*b* are attached. As shown in FIG. 2**, glider 146*b* is attached adjacent arm 116*b*, and another glider 146*b* (not shown) is attached in a similar position adjacent arm 118*b*. As shown in FIG. 3, gliders 146*a* and 146*b* are positioned to engage and slidably move along outside faces 44*a* and 44*b*, respectively, of beam 32. It should also be noted that vertical pivot axis 148*a* is closer to the vertical plane perpendicular to wall 16 in passing through the center of track 14 than any portion of glider 146*b*. The reason for this positioning is discussed subsequently. Base 142*b* is also provided with a sloping face 150*b* and a rounded tip 152*b*.

In operation, emergency escape system 10 functions in the following manner. Initially, when an emergency arises, most of the floors of the building can be evacuated normally using stairs or the like. However, in some cases one or more floors cannot be evacuated in the normal manner. In this case, emergency escape system 10 is utilized. Emergency escape system 10 is actuated by and under control of the emergency personnel. Initially, a switch, which is conveniently located on the main floor and under the jurisdiction of emergency personnel, is actuated to release the locks on storage cabinets 20 which are located on the floors which must be evacuated using emergency escape system 10. Preferably, this switch also releases the locks on balcony 18 or another emergency exit adjacent storage cabinet 20. Then, through the communications systems available on each floor of the building, directions are given to the occupants to use emergency escape system 10 including instructions on where the storage cabinets 20 are located and emergency exits such as balconies 18.

Provided in storage cabinet 20 are a plurality of travellers 12 to which associated harnesses 24 are attached by harness connectors 22. Upon being directed to balcony 18 which is used as the emergency exit, the user dons harness 24 while standing on balcony 18 so that emergency escape system 10 is then ready for use. Traveller 12 is then pushed into place on track 14 by the user. Once traveller 12 is in place on track 14, the user steps off of balcony 18 and allows traveller 12 to support his weight. Under the weight of the user, traveller 12 slowly travels along track 14 to safety below.

In lowering the user, traveller 12 functions in the following manner. Initially, the user grasps traveller 12 by handles 50*a* and 50*b* and aligns traveller 12 so that bases 142*a* and 142*b* are substantially parallel to and adjacent sloping faces 36*a* and 36*b*, respectively, of track 14. It should be noted that traveller 12 operates with either end up so that the designations "a" and "b" are used only for identifying purposes. With traveller 12 poised above track 14, the user then pushes traveller 12 onto track 14. As this occurs, sloping faces 150*a* and 150*b* of latches 114*a* and 114*b*, respectively, contact respective sloping faces 36*a* and 36*b*. This causes latches 114*a* and 114*b* to pivot against the force of spring clips such as spring clip 140*b* and to pivot to a position such as that shown by the dashed line in FIG. 3. As tips 152*a* and 152*b* clear sloping faces 36*a* and 36*b*, respectively, latches 114*a* and 114*b* are urged back to the position depicted in FIG. 3. In this position, gliders 108*a*, 108*b*, 110*a* and 110*b* are pressed into contact against respective outside faces 44*a* and 44*b* of beam 32. In addition, pinion 100 has been forced into position where teeth 102 intermesh with teeth 40 of rack 38.

After traveller 12 has been placed into position on track 14, the weight of the user then pulls downward on handles 50*a* and 50*b* as the user steps from balcony 18. Depending upon which end of traveller 12 is up, for example the end depicted in FIG. 3, the weight of the user causes gliders 146*a* and 146*b* to press against inside faces 42*a* and 42*b*, respectively, of beam 32 while gliders 110*a* and 110*b* are pressed against outside faces 44*a* and 44*b*, respectively, of beam 32. It should be noted that the clearance provided between gliders 110 and 146 is small enough to assure that teeth 102 of pinion 100 remains intermeshed with teeth 40 of rack 38.

As glider 146*b* is urged into contact with inside face 42*b*, a moment is created about pivot axis 148*b* of latch 114*b*. The rotational direction of this moment depends on the relative positionings of pivot axis 148*b* and the engaging surface of glider 146*b* to a vertical plane which is perpendicular to wall 16 and which passes through the center of traveller 12. By designing traveller 12 so that pivot axis 148*b* is closer, the moment always acts to urge latch 114*b* into the engaged position on track 14. Consequently, the more weight exerted on handles 50*a* and 50*b*, the more latches 114*a* and 114*b* are urged to maintain the engaged position on track 14 and to keep traveller 12 on track 14. Of course, absent any weight being exerted on traveller 12, only spring clips such as spring clip 140*b* hold latches 114*a* and 114*b* in position so that it is easy to position traveller 12 onto track 14.

As traveller 12 assumes the weight of the user, traveller 12 begins to move along track 14 as gliders 110*a*, 110*b*, 146*a* and 146 slide along track 14. This causes pinion 100 to rotate relative to track 14 as teeth 102 engage teeth 40 of rack 38. As pinion 100 rotates, shaft 92 similarly rotates and in turn causes rotors 70*a* and 70*b* of oil-hydraulic pump 68*a* and 68*b* to rotate. It should be noted that before storage, chambers 60*a* and 60*b* were filled with a suitable oil-hydraulic fluid which does not deteriorate over time. Therefore, as rotor 70*a* rotates, eccentrically mounted pump cartridge 72*a* similarly rotates due to the intermeshing of the mating teeth thereof. As pump cartridge 72*a* rotates, the oil-hydraulic fluid contained in chamber 60*a* is recurrently pumped by pump 68*a* through openings 76*a* and 78*a*. During operation of pump 68*a*, one or the other of openings of 76*a* and 78*a* is used as an inlet while the other opening is used as an outlet. Which opening 76*a* or 78*a* is used as the inlet depends upon the direction of travel of traveller 12 along track 14. In any event, the size of the smaller opening, in this embodiment opening 78*a*, controls the amount of fluid which can be conducted therethrough and hence the rotational speed at which pump 68*a* and hence rotor 70*a* operates. Therefore, as traveller 12 moves along track 14 under the weight of the user, traveller 12 moves at a predetermined speed to slowly lower the user to safety.

It should be noted that oil-hydraulic pumps 68*a* and 68*b* operate as redundant brakes on the motion of traveller 12. Normally, both pumps 68*a* and 68*b* operate together to retard the movement of traveller 12. However, should a malfunction occur with one pump, the other pump is capable of operating by itself to slow the movement of traveller 12 along track 14.

It should also be appreciated that even though oil-hydraulic pumps 68*a* and 68*b* have been described as Gerotor fixed displacement pumps, a piston gear or vane pump could also be used for the same purpose. The main consideration is that a fixed displacement pump displacing a specific amount of fluid which is regulated by a flow control device be provided.

It should further be appreciated that the location of storage cabinet 20 on balcony 18 is merely one possible arrangement. Where emergency escape system 10 is utilized in an office building, a locked central storage area on each floor containing a traveller for each worker could be provided. In an office building, the use of a locked window would probably be more appropriate, especially if balconies are not normally provided on the building. In apartments and hotels, the balcony for a room would not normally be centrally locked. However, a locked closet or other suitable area in the room could be provided to store travellers for each occupant. Other storage areas and exits are also possible.

While the present invention has been described with respect to an exemplary embodiment thereof, it will be understood by those of ordinary skill in the art that variations and modifications can be effected in the exemplary embodiment within the scope and spirit of the invention.

I claim:

1. A gravity operated emergency escape system for a multi-story building comprising:

an elongate track vertically disposed and in a spaced relationship to a wall of the building, said track including an inside face facing the wall and an outside face facing away from the wall;

a rack disposed in the center of said outside face along the length of said track;

a traveller which moves along said track including a pinion which rotatably engages said rack, a pair of bearing members which engage opposite horizontal sides of said inside face, and a pivot means for each of said bearing members for pivoting each said bearing member horizontally clear of the respective side of said inside face as said pinion is brought into contact with said rack and for thereafter resiliently urging each said bearing member into bearing contact on the respective sides of said inside face after said pinion fully engages said rack such that said pinion is held in said rack;

a velocity control means operatively connected to said pinion for controlling the rotational speed thereof and hence the speed of said traveller relative to said track; and a harness connection means on said traveller for connecting a user received in a harness to said traveller during an emergency whereby said traveller is then located on the track and slowly lowers the user to safety.

2. An emergency escape system as claimed in claim 1 wherein during use the pivot axis of each said bearing member is closer than any part of a respective said bearing member to a vertical place which is perpendicular to the wall and which passes through the vertical centerline of said inside face such that the moment about the pivot axis caused by each said bearing member engaging said inside face urges each said bearing member toward the vertical centerline of said inside face.

3. An emergency escape system as claimed in claim 2 wherein said pinion is disposed in the center of said traveller and further including a second pair of bearing members which is also attached to said pivot means so that one pair of bearing members is located above said pinion and the other pair of bearing members is located below said pinion such that the traveller operates with either end up.

4. An emergency escape system as claimed in claim 3 wherein said pivot means includes a pair of latch members on which respective ones of said pairs of bearing members are mounted, each said latch member including a sloping face which contacts the respective side of said track as said pinion is inserted into said rack and causes the latch members and bearing members to be pivoted outwardly relative to said track until said pinion is fully engaged in said rack and which then clears said sides such that said bearing members pivot inwardly into position on said inside face.

5. An emergency escape system as claimed in claim 4 and further including outside bearing members located substantially opposite said inside bearing members which contact the inside surface, said outside bearing members being disposed to contact the outside surface to provide a second bearing contact with said track to maintain said pinion securely in said track.

6. An emergency escape system as claimed in claim 5 wherein said bearing members are gliders which slide along said track.

7. An emergency escape system as claimed in claim 5 wherein said velocity control means includes a first oil-hydraulic brake connected to said pinion.

8. An emergency escape system as claimed in claim 7 wherein said velocity control means further includes a second oil-hydraulic brake connected to said pinion which serves as a redundant safety brake means for said traveller.

9. An emergency escape system as claimed in claim 7 wherein said track including said inner face and said outer face is substantially trapezoidally shaped in horizontal cross section with said inner face greater in horizontal length than said outer face.

10. An emergency escape system as claimed in claim 2 and further including a locked storage area on each floor of the building containing a plurality of said travellers and a remotely controlled release means for unlocking said storage area on each floor including an actuating switch located so as to be accessible to and under control of emergency evacuation personnel.

11. An emergency escape system as claimed in claim 10 and further including a locked exit on each floor adjacent said track and a remotely controlled release means for unlocking said exit when said storage area on that floor is unlocked and including an actuating switch located adjacent said storage area actuating switch.

12. An emergency escape system as claimed in claim 8 and further including a locked storage area on each floor of the building containing a plurality of said travellers and a remotely controlled release means for unlocking said storage area on each floor including an actuating switch located so as to be accessible to and under control of emergency evacuation personnel.

13. An emergency escape system as claimed in claim 12 and further including a locked exit on each floor adjacent said track and a remotely controlled release means for unlocking said exit when said storage area on that floor is unlocked and including an actuating switch located adjacent said storage area actuating switch.

14. A gravity operated emergency escape device for a multi-story building provided with an elongate track vertically disposed in a spaced relationship to a wall of the building and having an inside track face and an outside track face with a central rack therealong, the escape device comprising:

a traveller which moves along the track including a housing, a pinion located inside of said housing which rotatably engages the rack, a pair of bearing members which engage opposite horizontal sides of the inside face of the track, and a pivot means for each said bearing member for pivoting each said bearing member horizontally clear of the respective side of the track as said pinion is brought into contact with the rack and for thereafter resiliently urging each said bearing member into contact on the respective sides of the inside face of the track after said pinion fully engages the rack such that said pinion is held in the rack;

a velocity control means operatively connected to said pinion and located in said housing for controlling the rotational speed of said pinion and hence the speed of said traveller relative to the track; and a harness connection means on said housing for connecting a user received in a harness to said traveller during an emergency whereby said traveller is then located on the track and slowly lowers the user to safety.

15. A gravity operated emergency escape device for a multi-story building as claimed in claim 14 wherein said velocity control means includes a first oil-hydraulic brake connected to said pinion and a second oil-hydraulic brake connected to said pinion such that a redundant velocity control means is provided.

16. An emergency escape device as claimed in claim 15 wherein during use the pivot axis of each said bearing member is closer than any part of a respective said bearing member to a vertical place which is perpendicular to the wall and which passes through the vertical centerline of the inside face such that the moment about the pivot axis caused by respective said bearing members engaging the inside face urges said bearing members toward the vertical centerline of the inside face.

* * * * *